United States Patent [19]

Edwards et al.

[11] 4,378,152

[45] Mar. 29, 1983

[54] HOT ROLL FUSING NIP AND MEANS TO CONTROL ORIENTATION OF A SHEET'S LEADING EDGE THERETO

[75] Inventors: Earl G. Edwards; Michael R. Headrick, both of Boulder, Colo.

[73] Assignee: International Business Machines Corporation, Armonk, N.Y.

[21] Appl. No.: 764,254

[22] Filed: Jan. 31, 1977

[51] Int. Cl.[3] ..... G03G 15/20

[52] U.S. Cl. ..... 355/3 FU; 219/216; 355/35 H; 432/60

[58] Field of Search ..... 355/3 R, 3 FU, 3 SH; 432/60, 228; 271/209, 188; 219/216

[56] References Cited

U.S. PATENT DOCUMENTS

| | | | |
|---|---|---|---|
| 2,762,295 | 9/1956 | Varga et al. | 100/168 X |
| 3,039,388 | 6/1962 | Brandt et al. | 101/232 |
| 3,282,177 | 11/1966 | Stanton | 355/3 SH UX |
| 3,794,417 | 2/1974 | Machmer | 355/3 FU |
| 3,820,889 | 6/1974 | Nitanda et al. | 355/3 R |
| 3,846,151 | 11/1974 | Roteman et al. | 117/21 |
| 3,884,623 | 5/1975 | Slack | 432/60 |
| 3,948,214 | 4/1976 | Thettu | 432/60 X |
| 4,008,955 | 2/1977 | Bar-on | 355/3 R |

*Primary Examiner*—Fred L. Braun

*Attorney, Agent, or Firm*—Francis A. Sirr

[57] ABSTRACT

Fusing of a toned sheet of copy paper is accomplished by a fusing nip formed by a resilient hot roll and a rigid backup roll. The sheet is introduced to the fusing nip in a unique manner such that the sheet's initial contact to the hot roll fuser is substantially only a point on the sheet's leading edge. This is accomplished by orientation means operable to bow the sheet's leading edge, and/or to produce skew between the fusing nip and the sheet's leading edge.

14 Claims, 9 Drawing Figures

HOT ROLL FUSING NIP AND MEANS TO CONTROL ORIENTATION OF A SHEET'S LEADING EDGE THERETO

BACKGROUND AND SUMMARY OF THE INVENTION

The fusing of xerographic copies by a hot roll fuser, i.e. a hot roll in pressure contact with a cold or cool roll, is of course well known. In such a fuser the hot roll is maintained at an elevated temperature, sufficient to melt or soften the toner, thus causing the toner to adhere to the copy paper.

It has been found that unsightly toner patterns or tracks are sometimes formed when sheets are supplied to a straight-line fusing nip, i.e. the nip formed by two circular cylinders. While the cause of these tracks is not known, it is believed that the sheet sometimes fails to pass through the nip in a planar fashion, i.e. the portion of the sheet which has not entered the nip distorts, causing premature contact with the hot roll, thereby smearing the unfused toner image. Gross distortions, which may occur for example at relative humidities above 60%, may also cause wrinkling of the copy paper.

It has been found that this adverse phenomenon, associated with passing copy paper through a fusing nip formed by a circular cylinder hot roll in pressure contact with a circular cylinder cold backup roll, can be solved by providing a an orientation means and method whereby the sheet's initial physical contact to the fusing nip is essentially point contact, rather than the usual contact which comprises the sheet's entire leading edge, as has been done in the prior art. More specifically, the present invention provides a skewed approach orientation of a planar sheet to the fusing nip, and/or a non-planar, i.e. bowed, orientation approach of the sheet to the fusing nip. With the structure of the present invention, the sheet's initial contact occurs at a point. With a skewed approach, this point is a leading corner of the sheet. With a bowed approach a single point, usually near the center of the leading edge, first contacts the surface of the backup roll, and then moves into the fusing nip.

The present invention has been found to have particular utility where the fusing nip is formed by a resilient hot roll and a non-resilient backup or cold roll.

The general concept of guiding a sheet to the fusing nip is, or course, well known. In the art of hot roll fusing, it is also known that creasing of the sheet, as it passes through the fusing nip, is reduced by the use of a rigid, concave-hollow cylindrical hot roll, and a complementary shaped resilient pressure or backup roll.

In the art of liquid developing electrophotography it is known that the transfer step may be improved by guiding the sheet to the transfer station such that the sheet's leading edge describes a curve when initially contacting a drum photoconductor.

The foregoing and other features and advantages of the invention will be apparent from the following more particular description of preferred embodiments of the invention, as illustrated in the accompanying drawing.

DESCRIPTION OF THE PREFERRED EMBODIMENTS

Figure 1:
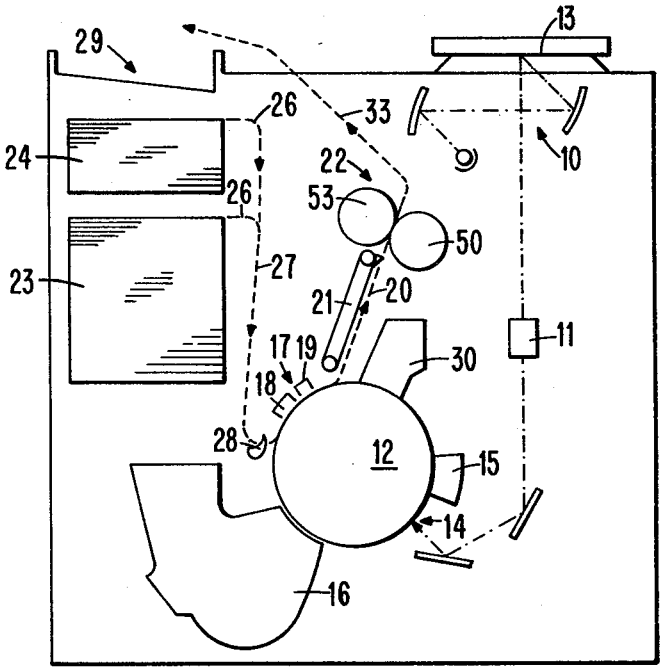
FIG. 1 is a schematic front view of a xerographic copier incorporating the present invention.

FIG. 1 is a schematic view of a xerographic copier incorporating the present invention, for example the IBM Series III copier/duplicator. In this device a scanning mirror system 10 and a moving lens 11 move in synchronism with the rotation of photoconductor drum 12 to place a latent image of stationary original document 13 onto the drum's surface. As is well known, prior to imaging at 14, the drum is charged by corona 15. After imaging, the drum's latent image is developed by magnetic brush developer 16. Thereafter the drum's toned visible image is transferred to a sheet of copy paper at transfer station 17 by operation of transfer corona 18. Sheet detach means 19 operates to cause the now toned sheet to leave the surface of the drum and to follow sheet movement path 20, adjacent vacuum conveyor 21, on its way to hot roll fuser assembly 22. As the sheet moves through path 20, the sheet's straight leading edge is generally perpendicular to path 20. After fusing, the finished copy sheet follows sheet path 33 and is deposited in output tray 29. After transfer, the drum is cleaned as it passes cleaning station 30.

The apparatus of FIG. 1 includes two copy sheet supply bins 23 and 24. These supply bins include a bidirectionally, vertically movable elevator which supports the stack. While this structure is well known to those of skill in the art, an exemplary structure is described in the IBM *TECHNICAL DISCLOSURE BULLETIN* of August 1974, at pages 670 and 671. The selected bin is operable to feed the top sheet of the stack to its sheet discharge path 26. This sheet then travels down sheet path 27 to be momentarily stopped at gate 28. An exemplary means of picking the top sheet from the selected bin is described in the IBM TECHNICAL DISCLOSURE BULLETIN of February 1974, at pages 2966 and 2967. Shortly after the leading edge of the drum's toned image arrives at the gate, the gate is opened to allow the sheet to move into transfer station 17 with its leading edge in exact registry with the drum's image leading edge.

The construction of hot roll fuser assembly 22 will not be described in detail since this construction is well known in the art. Generally, hot roll 50 is heated to an accurately controlled temperature by an internal heater and an associated temperature control system, not shown. The hot roll preferably includes a deformable external surface formed as a thin elastomeric surface. This surface is designed to engage the toned side of the copy sheet, fuse the toner thereon, and readily release the sheet with a minimum adherance of residual toner to the hot roll. Such a hot roll is described, for example, in the IBM TECHNICAL DISCLOSURE BULLETIN of August 1973, at page 896.

As is conventional in hot roll fusers, the sheet's toned side faces the hot roll.

Backup roll 53 is preferably a relatively cool and rigid roll. Rolls 50 and 53 are circular cylinders, such that the fusing nip formed thereby defines a line (of some width due to deformation of hot roll 50) parallel to the axis of rolls 50 and 53.

The fusing nip formed by rolls 50 and 53 may be opened and closed in synchronism with the arrival and departure of the copy sheet's leading and trailing edges, respectively. This synchronism is achieved by a drum position sensing means, not shown, which responds to the position of drum 12 and effects opening and closing of the nip by means of a copier control system, not shown. An exemplary mechanism for effecting the opening and closing of this nip is shown in the *IBM TECHNICAL DISCLOSURE BULLETIN* of May 1973, at page 3644. In the alternative, for a multicopy run, the fusing nip may continuously remain closed until the trailing end of the last sheet has passed therethrough.

Sheet supply bins 23 and 24 are constructed and arranged to adjustably hold cut sheets of transfer material of different sizes, for example letter and legal size paper. Sheets therein are oriented such that their narrow dimension is in the direction of paper feed 27. In addition, the sheets in each bin are stacked such that their rearmost narrow edge (which is parallel to the direction of paper feed 27) lies in a common vertical plane. Thus, if bin 24 contains legal size paper, its front narrow edge overlaps the front narrow edge of letter size paper in bin 23 by some three inches. As a sheet travels down sheet path 27 its long leading edge is presented to transfer station 17 such that this edge is substantially parallel to the axis of photoconductor drum 12.

Figure 2:
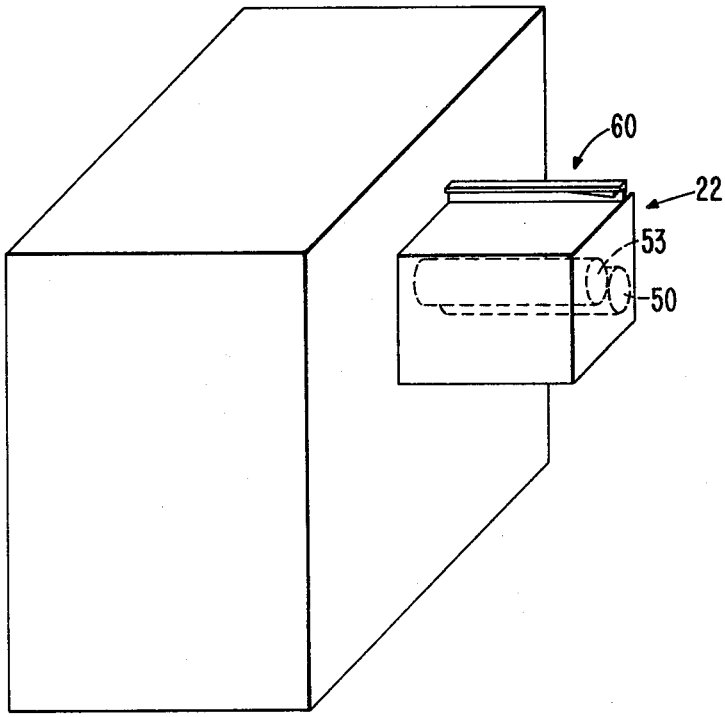
FIG. 2 is a generalized showing of FIG. 1's copier and its hot roll fuser as it appears when it is pulled out of the copier front surface, to a non-operating position, as for example to facilitate jam clearance.

FIG. 2 shows fuser assembly 22 in its extended or pulled-out position. Assembly 22 is pulled out of the front of the copier, and other copier means are not shown for purposes of simplicity. This is a non-operating position adapted to facilitate inspection, cleaning, repair and/or sheet jam clearance. Fuser assembly is slidably supported by a pair of rail assemblies, one of which is shown at 60. Each rail assembly includes a plurality of stationary internal rollers over which a rail slidably moves. These rails support the fuser assembly, and move therewith.

Figure 3:
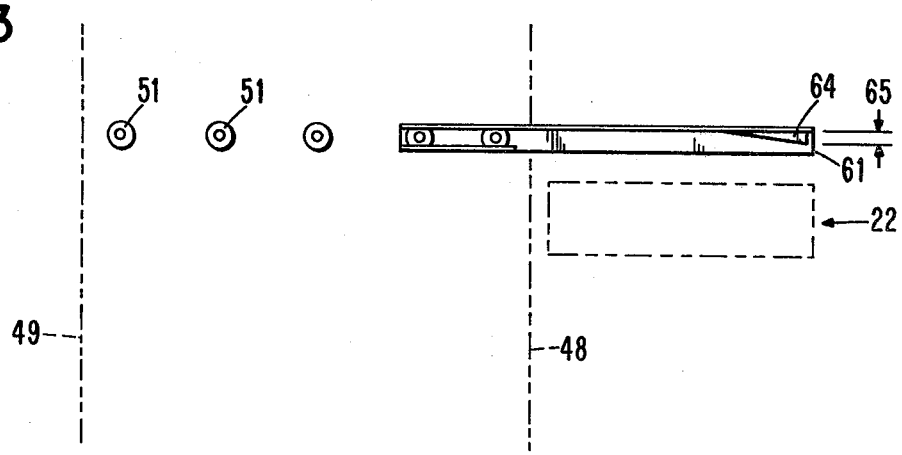
FIG. 3 is a view of one of the two similar rails which support FIG. 1's hot roll fuser within the copier in a manner such that it can be pulled out to the FIG. 2 position, and showing a ramp orientation means thereon which skews or lifts the outboard end of the fuser, such that the fusing nip is non-parallel to the leading edge of a sheet to be fused, when the fuser has been pushed back into the copier, to its operating position.

FIG. 3 shows one of these fuser-mounting rails 61. The front and rear walls of the copier are shown by dotted lines 48 and 49, respectively. Each of these rails includes an end-located ramp 64 which operates to lift the end of fuser assembly 22 a distance 65 as the fuser assembly is returned to its operating position. Each of the two fuser-supporting rails cooperates with five rollers 51 mounted at fixed positions internal the copier. The rollers define a horizontal line perpendicular to sheet path 20. As shown, the internal end of each rail includes a bottom lip, such that the rollers cooperating therewith are inprisoned between this bottom lip and the rail's continuous upper lip. At the right-hand end, this lower lip is cut away to facilitate the lifting achieved by ramp 64. As the fuser assembly is returned to its operating position, ramp 64 cooperates with the right-most outboard roller 51, and climbs upon top of that roller. In this manner, rail assembly 60, and its similar assembly, not shown, operate to support the fuser assembly in its operating position such that its fusing nip is skewed to the direction of paper movement 20, i.e. non-perpendicular thereto.

Figure 6:
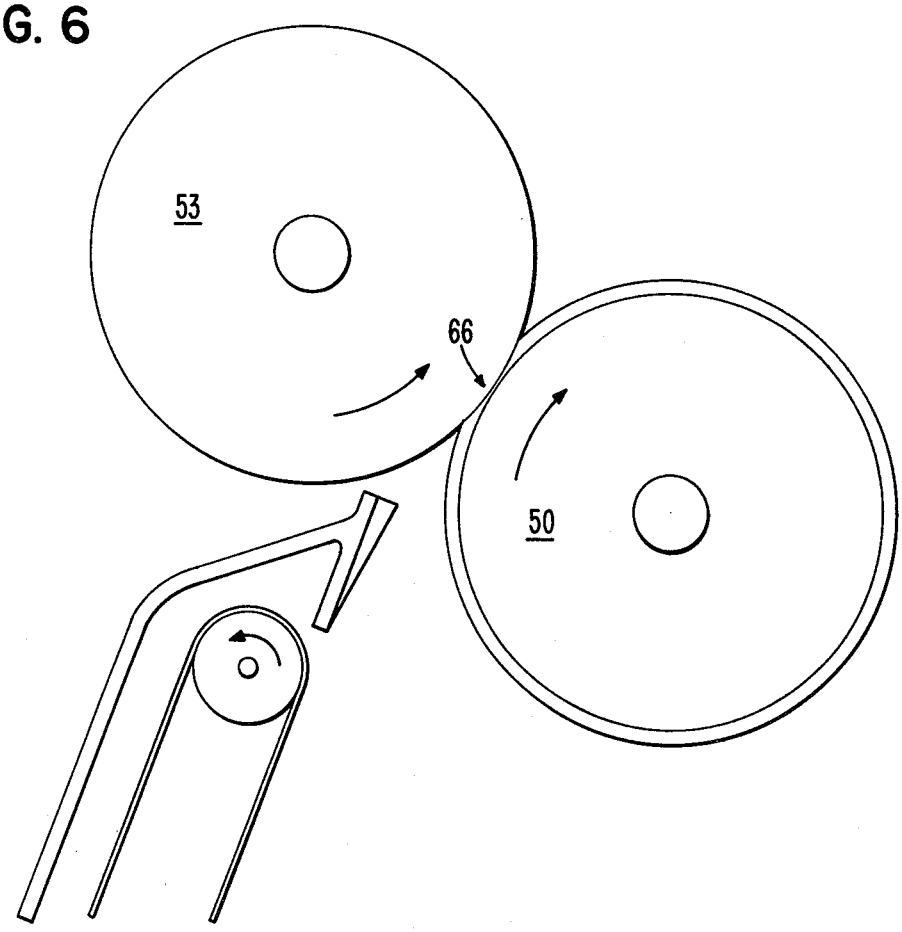
FIG. 6 is a side view of the closed fusing nip and the sheet bowing embodiment of FIGS. 4 and 5.

Stated in another way, fusing nip 66 of FIG. 6 comprises a depression into the resilient surface of hot roll 50 by rigid backup roll 53. This nip has a width of approximately 0.21 inch measured in the direction of sheet movement; see FIG. 9. While the nip has a definite width, as shown, it generally defines a fusing line which is parallel to the rotational axis of rolls 50 and 53. Ramps 64 operate to lift, tilt or skew this fusing line to be non-perpendicular to the direction of FIG. 1's sheet movement path 20, as shown in exaggerated form in FIG. 9.

In an alternative construction, rollers 51 can be mounted non-horizontal as to define a skewed fusing nip.

Note that the fuser assembly's skew is such as to lift the end of the fuser assembly which faces the front of the copier. Since the sheets in FIG. 1's bins 23 and 24 usually are of different sizes, i.e. letter and legal size, with common-edge referencing to the rear of the copier, this manner of skewing the fuser assembly produces little or no difference in time of fusing nip arrival of the sheet's rear leading-edge corner (see 71, FIG. 9), independent of sheet size.

Since rolls 50 and 53 must fuse sheets of different length, which are fed in the direction of their narrow dimension, the rolls must be at least as long as the longest sheet to be fused. In practice, rolls 50 and 53 are generally 15 inches long and have a circumference of 9.5 inches.

Figure 9:
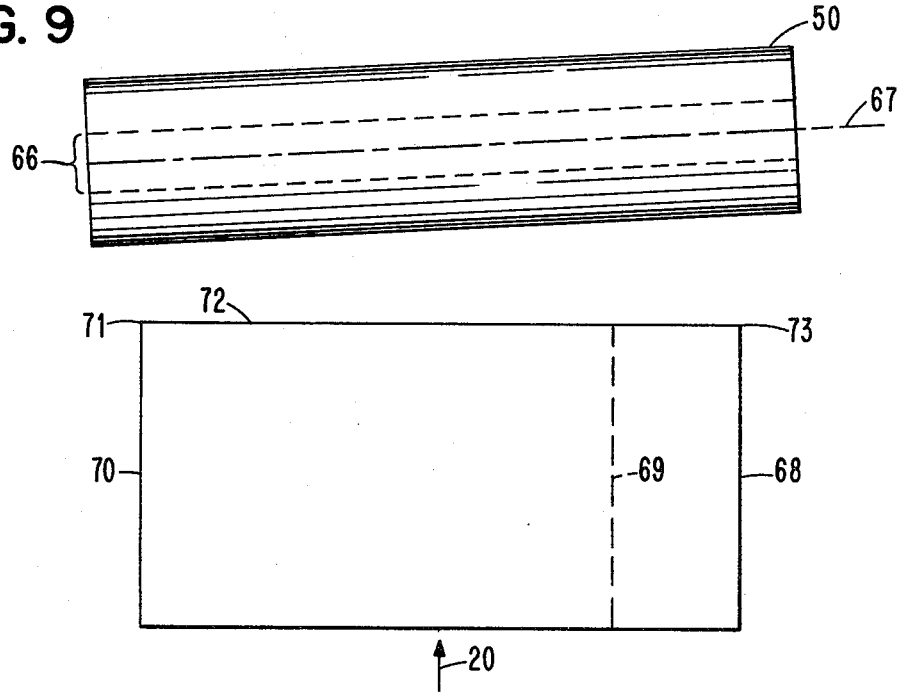
FIG. 9 is a view of the skewed fusing nip and the sheet's leading edge as produced by the structure of FIG. 3.

FIG. 9 depicts skewed hot roll 50, having fusing nip 66 whose center line 67 is skewed to the direction of sheet movement 20. For purposes of illustration, the skew is exaggerated. A large sheet 68 is shown approaching the fusing nip. This view is taken looking at the non-toner side of the sheet. If a shorter sheet 69 were approaching the nip, it would occupy a common edge 70 with the large sheet, this edge being at the back of the copier. Both size sheets present a common leading edge 72, this edge being generally perpendicular to sheet path 20. Both size sheets present a common rear leading edge corner 71 as the first point on a sheet to engage fusing nip 66.

Preferably the point 71 enters the fusing nip 0.06 inch ahead of the opposite leading edge corner of a short sheet, and 0.08 inch ahead of the opposite leading edge corner 73 of a large sheet. A preferred range has been found to be from 0.05 to 0.1 inch.

While the detailed construction of vacuum conveyor 21, operable to establish sheet path 20, forms no portion of the present invention, it is preferable, in accordance with the present invention, that transport 21 be constructed and arranged such that the sheet's leading edge first engages the surface of backup roll 53, and then moves into fusing nip 66.

Figure 4:
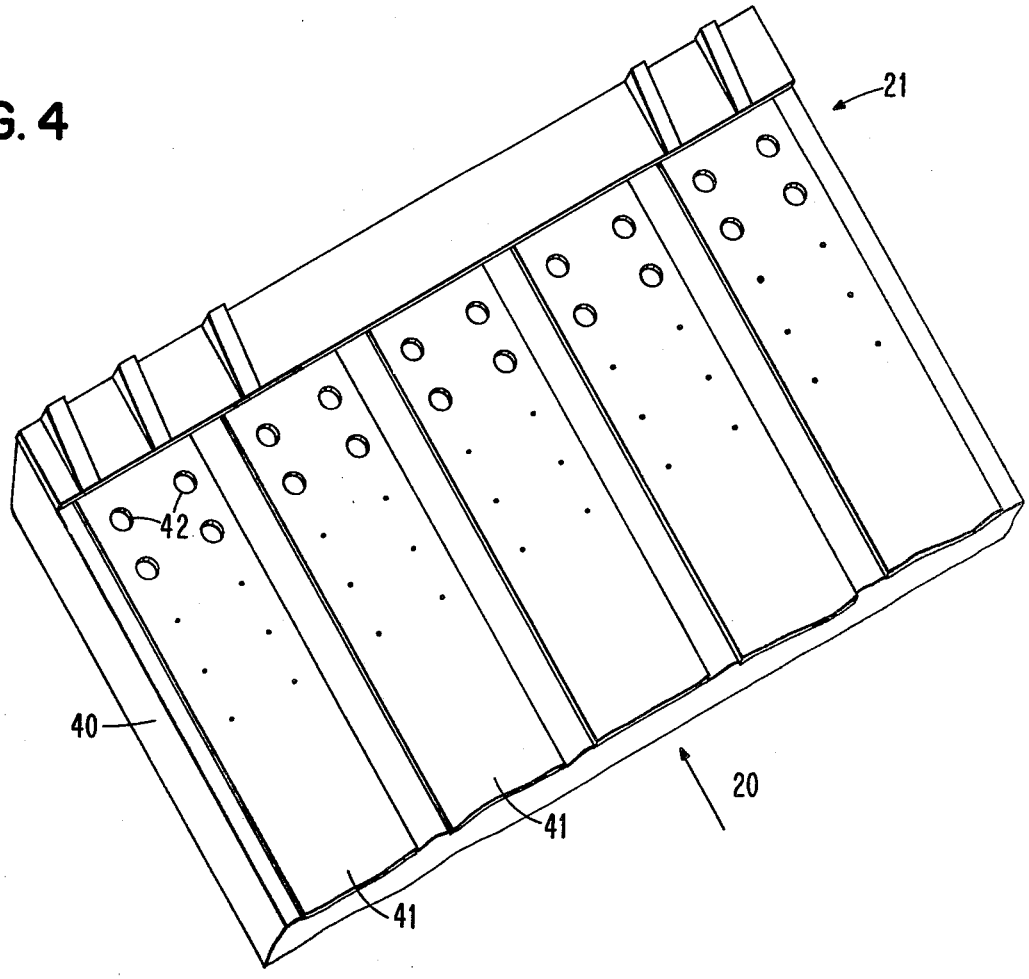
FIG. 4 is a view of FIG. 1's vacuum conveyor, immediately upstream of the copier's transfer station, and downstream of the fusing nip, and showing orientation means in the form of lift wedges which bow the leading edge of a sheet to be fused, such that a generally central point on the sheet's leading edge is the first point to engage a fuser roll, and specifically the backup roll.

Generally, transport 21, FIG. 4, includes a vacuum plenum 40 which cooperates with a plurality of transport belts 41 having openings 42 therein, such that as the belts transport the paper in an upward direction along path 20, the paper is held to the belts by vacuum force, toner side facing away from the belts.

Vacuum transport 21 operates to "aim" the sheet's leading edge into the surface of backup roll 53, slightly ahead of the fusing nip. In this manner, with reference to FIG. 9, the sheet's leading edge corner 71 first engages the backup roll, and then fusing nip 66. While the exact phenomenon of avoiding unsightly patterns or tracks in the fused toner image is not understood, it is believed that the progressive "ironing" of the sheet as it passes through the skewed fusing nip prevents wrinkling of the sheet by progressively increasing the sheet's engagement to the fusing nip, as the sheet's leading edge 72 gradually becomes completely immersed in fusing nip 66. This gradual immersion in the fusing nip progresses from leading edge corner 71 to the opposite leading edge corner 73, as the leading edge is completely immersed.

Figure 5:
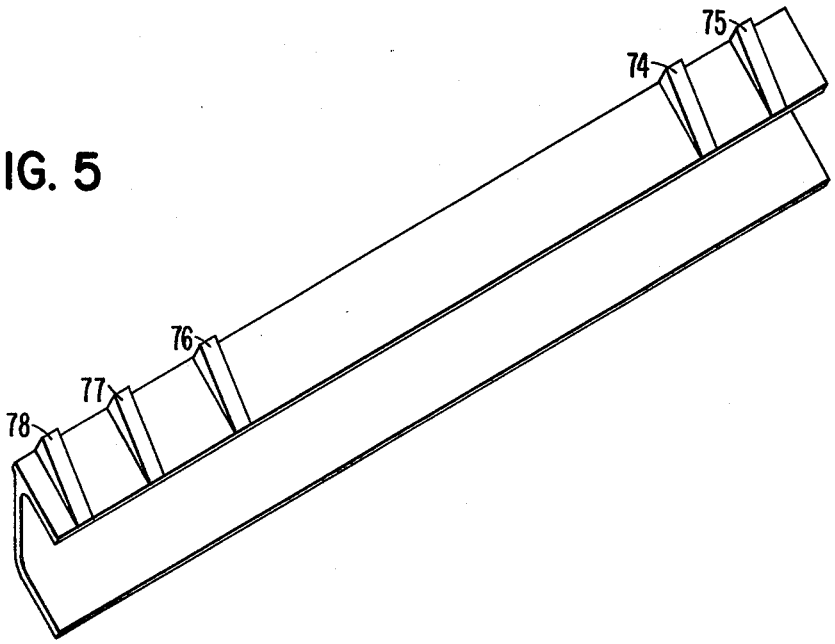
FIG. 5 is a view of the wedge-carrying member of FIG. 4's vacuum conveyor, and showing the three wedges on the outboard end thereof which accommodate the extending edge of long, legal size paper to be fused.

FIGS. 4 and 5 disclose a further embodiment of the present invention wherein vacuum conveyor 21 is provided at its upper fuser-adjacent end with lift wedges which bow the leading edge of the sheet to be fused. These lift wedges are best shown in FIG. 5, where only the terminal member of the vacuum conveyor is disclosed. This terminal member includes a pair of lift wedges 74 and 75 which are located at the back of the copier and thus cooperate with the common end (see 70, FIGS. 8 and 9) of sheets of different size. At the other end of the vacuum conveyor, i.e. at the front of the copier, three lift wedges 76, 77 and 78 cooperate with the variable length ends of sheets of different sizes. Four wedges can be provided at this end, if desired. Certain of these cooperate with letter size paper whereas all wedges at this end cooperate with legal size paper.

As an alternate embodiment of the structure of FIG. 5, this member may be formed with continuously raised and contoured surfaces 80 and 81 (see FIG. 7), each of which terminates in an off-center located non-raised portion 82. This non-raised portion 82 is adapted to cooperate with the approximate center of letter size paper and is off-center for legal size paper, since both sizes have their common rearward narrow edge 70 (FIGS. 8 and 9) referenced to the same point on raised surface 80.

Figure 7:
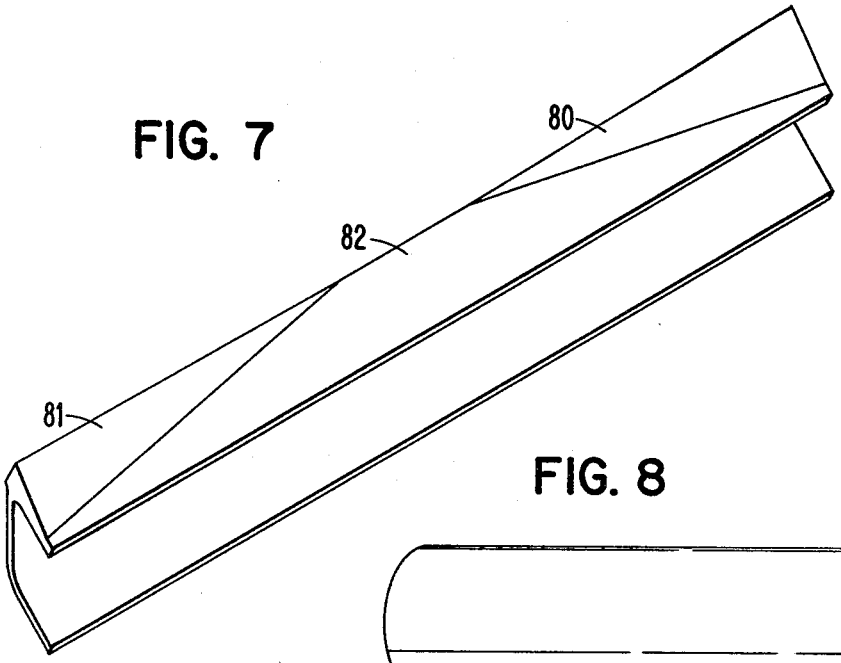
FIG. 7 is a view of a modification of the orientation means structure of FIG. 5, which modification provides two raised, contoured surfaces to bow the leading edge of the sheet to be fused.

FIG. 6 is a side view of closed fusing nip 66, and the sheet bowing achieved by the structures of either FIG. 5 or 7.

Figure 8:
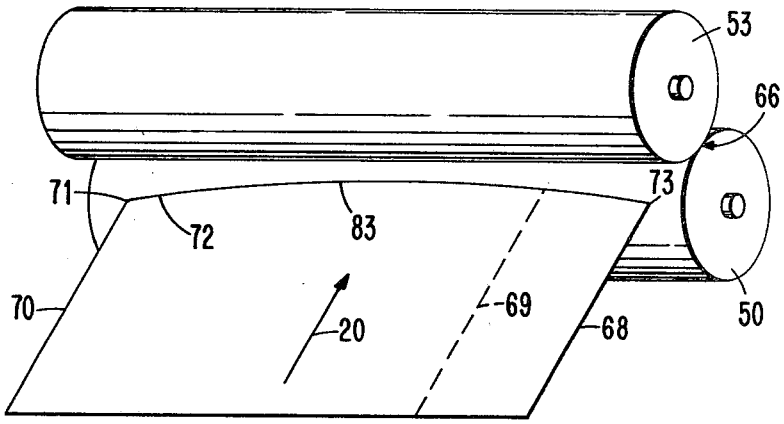
FIG. 8 is a view of the closed fusing nip and the generally bowed state of the sheet's leading edge, as produced by the structures of FIGS. 4, 5, 6 and 7.

FIG. 8 is a view of closed fusing nip 66, showing the generally bowed state of the sheet's leading edge 72 as the sheet proceeds along sheet path 20 toward the fusing nip. This view is taken from the vacuum conveyor side of the sheet, as is FIG. 9, i.e. looking at the sheet's non-toner surface. The sheet's leading edge 72 is bowed such that its two leading edge corners 71 and 73 are essentially lifted away from the surface of backup roll 53 such that a point 83, on the sheet's leading edge will be the first point to engage the surface of backup roll 53, as the sheet's leading edge moves into closed fusing nip 66. This point 83 is approximately centrally located on letter size paper, and is off-center of legal size paper. In either event, the paper tends to be flattened against the backup roll, with this flattening progressing from point 81 outwardly toward both edge 70 and edges 68, 69 (depending upon sheet length) as the sheet's leading edge 72 approaches the fusing nip.

While it has been found that either bowing of the sheet's leading edge, or producing relative skew between the fusing nip and the sheet's leading edge eliminates undesirable toner patterns or tracks on the fused copy, it is preferable to incorporate both of these structures, i.e. a structure in which the vacuum transport 20 produces sheet bow, as shown in FIG. 8, and the fuser support means produces relative skew, as shown in FIG. 9.

While the invention has been particularly shown and described with reference to preferred embodiments thereof, it will be understood by those skilled in the art that various changes in form and details may be made therein without departing from the spirit and scope of the invention.

What is claimed is:

1. A copier wherein a dry toner image is carried by a sheet of transfer material, having a hot roll fuser comprising a cylindrical hot roll and a cylindrical backup roll having parallel axes, and in pressure contact to thus form a straight-line fusing nip, and orientation means capable to control the relationship of the sheet's leading edge and said fusing nip so as to cause said fusing nip to be skewed to the sheet's leading edge so as to introduce a sheet to said fusing nip such that the initial contact of the sheet's leading edge to said nip is substantially a point on the leading edge of the sheet.

2. The copier defined by claim 1 wherein said orientation means comprises means operable to produce relative skew between said fusing nip and the sheet's leading edge, such that one corner of the sheet's leading edge enters the fusing nip in the range of from 0.05 to 0.10 inch ahead of the other corner thereof.

3. The copier defined by claim 1 wherein said fusing nip is formed by a resilient hot roll and a relatively cool non-resilient backup roll.

4. The copier defined by claim 1 wherein sheets of different sizes enter the fusing nip with one side edge in common registration, wherein said orientation means is operable to skew said fusing nip in a manner to offset the side of the fuser opposite said common edge registration in the direction of sheet movement.

5. The copier defined by claim 4 wherein said fusing nip is formed by a resilient hot roll and a non-resilient backup roll.

6. A copier wherein a dry toner image is carried by a sheet of transfer material, having a hot roll fuser comprising a cylindrical hot roll and a cylindrical backup roll having parallel axes, and in pressure contact to thus form a straight-line fusing nip, orientation means operable to control the relationship of the sheet's leading edge and said fusing nip so as to introduce a sheet to said fusing nip such that the initial contact of the sheet's leading edge to said nip is substantially a point on the leading edge of the sheet, said orientation means comprising fuser support means operable to support said fuser such that its fusing nip is skewed to the sheet's leading edge, and a sheet guide mounted immediately prior to said fusing nip and supporting said sheet so as to bow the sheet's leading edge, immediately prior to its entering said fusing nip, in a direction generally parallel to the direction of the sheet's movement.

7. The copier defined by claim 6 wherein sheets of different sizes are fused with one narrow side edge in common registration, wherein said fuser support means operates to skew said fusing nip in a manner to move the side of said nip opposite said common edge registration in the direction of sheet feeding.

8. The copier defined by claim 7 wherein said fusing nip is formed by a resilient hot roll and a substantially rigid backup roll.

9. A copier wherein a dry toner image is carried by a sheet of transfer material, having a hot roll fuser comprising a cylindrical hot roll and a cylindrical backup roll having parallel axes, and in pressure contact to thus form a straight-line fusing nip, orientation means operable to control the relationship of the sheet's leading edge and said fusing nip so as to introduce a sheet to said fusing nip such that the initial contact of the sheet's leading edge to said nip is substantially a point on the leading edge of the sheet, said orientation means comprising means operable between the feed path of said sheet and said fusing nip so as to provide skewed orientation between said fusing nip and the leading edge of said sheet.

10. The copier defined by claim 9 wherein said feed path includes a sheet guide immediately prior to said fusing nip, said sheet guide being operable to bow said sheet in a direction non-parallel to the sheet's leading edge.

11. The copier defined by claim 10 wherein said sheet guide is operable to lift the end corners of the sheet's leading edge away from said backup roll.

12. A method for hot-roll fusing dry toner to a sheet of transfer material comprising the step of introducing the sheet to a straight-line fusing nip, formed by two parallel-axes fusing rolls which are in pressure contact, wherein the fusing nip and the sheet's leading edge are skewed, such that initial contact of the sheet's leading edge is substantially a point on the sheet's leading edge.

13. The method defined by claim 12 wherein the leading edge of the sheet is bowed in a direction non-parallel to the sheet's leading edge, so as to lift the corners of the sheet's leading edge away from the hot-roll fuser's backup roll.

14. The method defined by claim 13 wherein said point first engages the backup roll and then moves into the fusing nip.

* * * * *

UNITED STATES PATENT AND TRADEMARK OFFICE

CERTIFICATE OF CORRECTION

PATENT NO. : 4,378,152

DATED : March 29, 1983

INVENTOR(S) : Earl G. Edwards and Michael R. Headrick

It is certified that error appears in the above—identified patent and that said Letters Patent is hereby corrected as shown below:

Column 6, claim 1, line 30, "capable" should be --operable--.

Signed and Sealed this

*Twenty-third* Day of *August 1983*

[SEAL]

*Attest:*

GERALD J. MOSSINGHOFF

*Attesting Officer*

*Commissioner of Patents and Trademarks*